US007671760B2

(12) United States Patent
Vallejo, Sr.

(10) Patent No.: US 7,671,760 B2
(45) Date of Patent: Mar. 2, 2010

(54) TRAFFIC SIGNAL SYSTEM

(76) Inventor: Saul Vallejo, Sr., 306 46th Ave. SE., Salem, OR (US) 97317

( * ) Notice: Subject to any disclaimer, the term of this patent is extended or adjusted under 35 U.S.C. 154(b) by 392 days.

(21) Appl. No.: 11/614,520

(22) Filed: Dec. 21, 2006

(65) Prior Publication Data

US 2008/0150758 A1 Jun. 26, 2008

(51) Int. Cl.
*G08G 1/095* (2006.01)

(52) U.S. Cl. ..... 340/907; 340/471; 340/815.45; 340/332

(58) Field of Classification Search ..... 907/907, 907/944, 916, 925, 931, 908, 908.1, 468, 907/471, 815.4, 815.45, 909, 641, 642, 332, 907/286.01
See application file for complete search history.

(56) References Cited

U.S. PATENT DOCUMENTS

| | | | | |
|---|---|---|---|---|
| D98,995 | S | 3/1936 | Bissell | |
| D150,229 | S | 7/1948 | Haugard | |
| 2,625,598 | A | 1/1953 | Broussard et al. | |
| D178,007 | S | 6/1956 | Pettengil | |
| 3,049,614 | A | 8/1962 | Elkenberry | |
| 3,200,218 | A | 8/1965 | Wagner | |
| D213,925 | S | 4/1969 | Cheslock | |
| D215,508 | S | 10/1969 | Albrecht | |
| 3,480,909 | A | 11/1969 | Hines | |
| 3,533,062 | A | 10/1970 | Coffman | |
| 3,618,005 | A | 11/1971 | Jensen | |
| 4,629,943 | A | 12/1986 | Ponce, Jr. | |
| 4,915,466 | A * | 4/1990 | Sorensen et al. | 385/56 |
| 5,504,481 | A | 4/1996 | Wys | |
| 5,782,555 | A | 7/1998 | Hochstein | |
| 5,898,381 | A * | 4/1999 | Gartner et al. | 340/815.65 |
| 6,107,941 | A | 8/2000 | Jones | |
| 6,283,613 | B1 * | 9/2001 | Schaffer | 362/245 |
| 6,357,902 | B1 * | 3/2002 | Horowitz | 362/545 |
| 6,448,779 | B1 * | 9/2002 | Beaver et al. | 324/504 |
| 6,522,263 | B2 | 2/2003 | Jones | |
| 6,822,556 | B2 * | 11/2004 | Burns et al. | 340/332 |
| 6,847,306 | B2 * | 1/2005 | Diba et al. | 340/906 |
| 6,850,169 | B2 * | 2/2005 | Manavi et al. | 340/902 |
| 7,006,011 | B1 | 2/2006 | Colby | |
| 2005/0094407 | A1 | 5/2005 | Heald et al. | |

FOREIGN PATENT DOCUMENTS

| | | |
|---|---|---|
| DE | 3409841 | 8/1985 |
| JP | 200520897 | 1/2005 |
| RE | 30355 | 7/1980 |

OTHER PUBLICATIONS

Patent Cooperation Treaty, Notification of Transmittal of the Int'l Search Report and Written Opinion, International Application No. PCT/US07/87185, Apr. 11, 2008, 9 pages.
Locking Devices Product Comparison, Retrieved Aug. 31, 2006, from www.hubbellcatalog.com.
Patent Cooperation Treaty, "Notification of Transmittal of International Preliminary Report on Patentability", PCT/US07/87185, Sep. 3, 2009, 8 pages.

* cited by examiner

*Primary Examiner*—Daniel Previl

(57) ABSTRACT

A traffic signal system for utilizing an efficient and simplistic structure to regulate vehicle and pedestrian traffic. The traffic signal system includes a support member including at least one receiver member and at least one light module including a plug member extending outwardly from the light module, wherein the plug member is positionable within a cavity of the receiver member.

20 Claims, 6 Drawing Sheets

TRAFFIC SIGNAL SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to traffic lights and more specifically it relates to a traffic signal system for utilizing an efficient and simplistic structure to regulate vehicle and pedestrian traffic.

2. Description of the Related Art

Any discussion of the prior art throughout the specification should in no way be considered as an admission that such prior art is widely known or forms part of common general knowledge in the field.

Traffic lights have been in use for years. Typically, traffic lights are used as signaling devices and are positioned at places, such as but not limited to road intersections and pedestrian crossings to indicate whether it is safe to proceed.

Traffic lights are generally comprised of a container holding a plurality of lights. When replacing or performing maintenance on the traffic lights it is generally required to hingedly open and close the container to gain access to the traffic light. There is generally a wide array of movable parts and wiring associated with the container of the traffic lights, which makes performing maintenance on traffic lights tedious and cumbersome.

Traffic lights are also generally positioned at a high vertical height with a minimal amount of support structures nearby. Because of the lack of support structures, it is generally preferred to spend a minimal amount of time maintaining traffic lights. Traffic lights that include a wide array of parts and complicated container structures generally take longer to perform maintenance on because of the difficulty in accessing the traffic light.

While these devices may be suitable for the particular purpose to which they address, they are not as suitable for utilizing an efficient and simplistic structure to regulate vehicle and pedestrian traffic. Traffic lights with complicated container structures can prove to be tedious in performing maintenance on and also generally have an unnecessarily large amount of parts that are subjectable to being lost over time.

In these respects, the traffic signal system according to the present invention substantially departs from the conventional concepts and designs of the prior art, and in so doing provides an apparatus primarily developed for the purpose of utilizing an efficient and simplistic structure to regulate vehicle and pedestrian traffic.

BRIEF SUMMARY OF THE INVENTION

In view of the foregoing disadvantages inherent in the known types of traffic lights now present in the prior art, the present invention provides a new traffic signal system construction wherein the same can be utilized for utilizing an efficient and simplistic structure to regulate vehicle and pedestrian traffic.

The general purpose of the present invention, which will be described subsequently in greater detail, is to provide a new traffic signal system that has many of the advantages of the traffic lights mentioned heretofore and many novel features that result in a new traffic signal system which is not anticipated, rendered obvious, suggested, or even implied by any of the prior art traffic lights, either alone or in any combination thereof.

To attain this, the present invention generally comprises a support member including at least one receiver member and at least one light module including a plug member extending outwardly from the light module, wherein the plug member is positionable within a cavity of the receiver member.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a traffic signal system that will overcome the shortcomings of the prior art devices.

A second object is to provide a traffic signal system for utilizing an efficient and simplistic structure to regulate vehicle and pedestrian traffic.

Another object is to provide a traffic signal system that does not require the use of tools to interchange traffic lights.

An additional object is to provide a traffic signal system that utilizes a light system comprised of a LED signal module.

A further object is to provide a traffic signal system that easily mountable.

A further object is to provide a traffic signal system that does not have any exposed electrical wiring.

A further object is to provide a traffic signal system that is lightweight.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
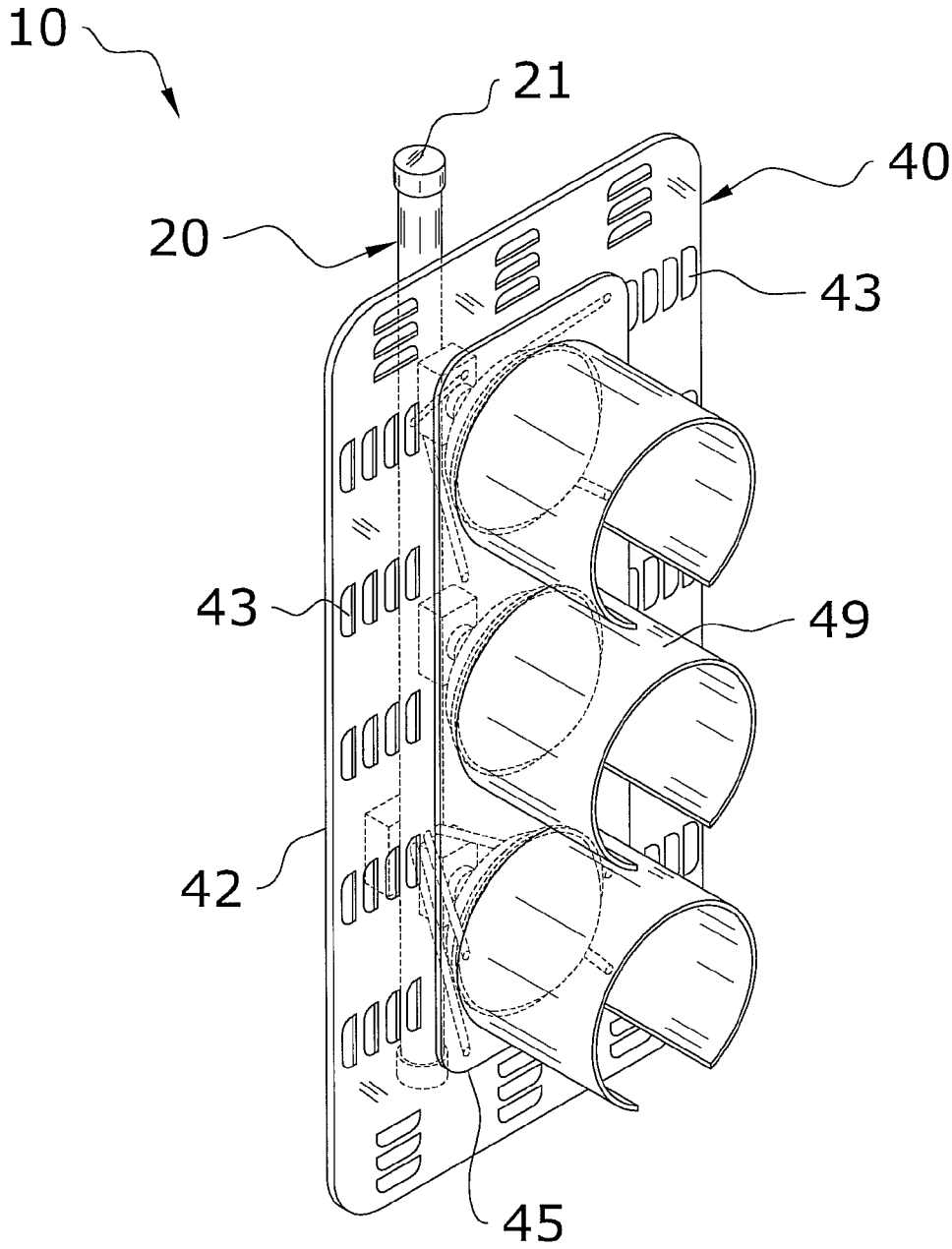
FIG. 1 is an upper perspective view of the present invention.

Turning now descriptively to the drawings, in which similar reference characters denote similar elements throughout the several views, FIGS. 1 through 6 illustrate a traffic signal system 10, which comprises a support member 20 including at least one receiver member 24 and at least one light module 50 including a plug member 52 extending outwardly from the light module 50, wherein the plug member 52 is positionable within a cavity 26 of the receiver member 24.

B. Support Member

Figure 2:
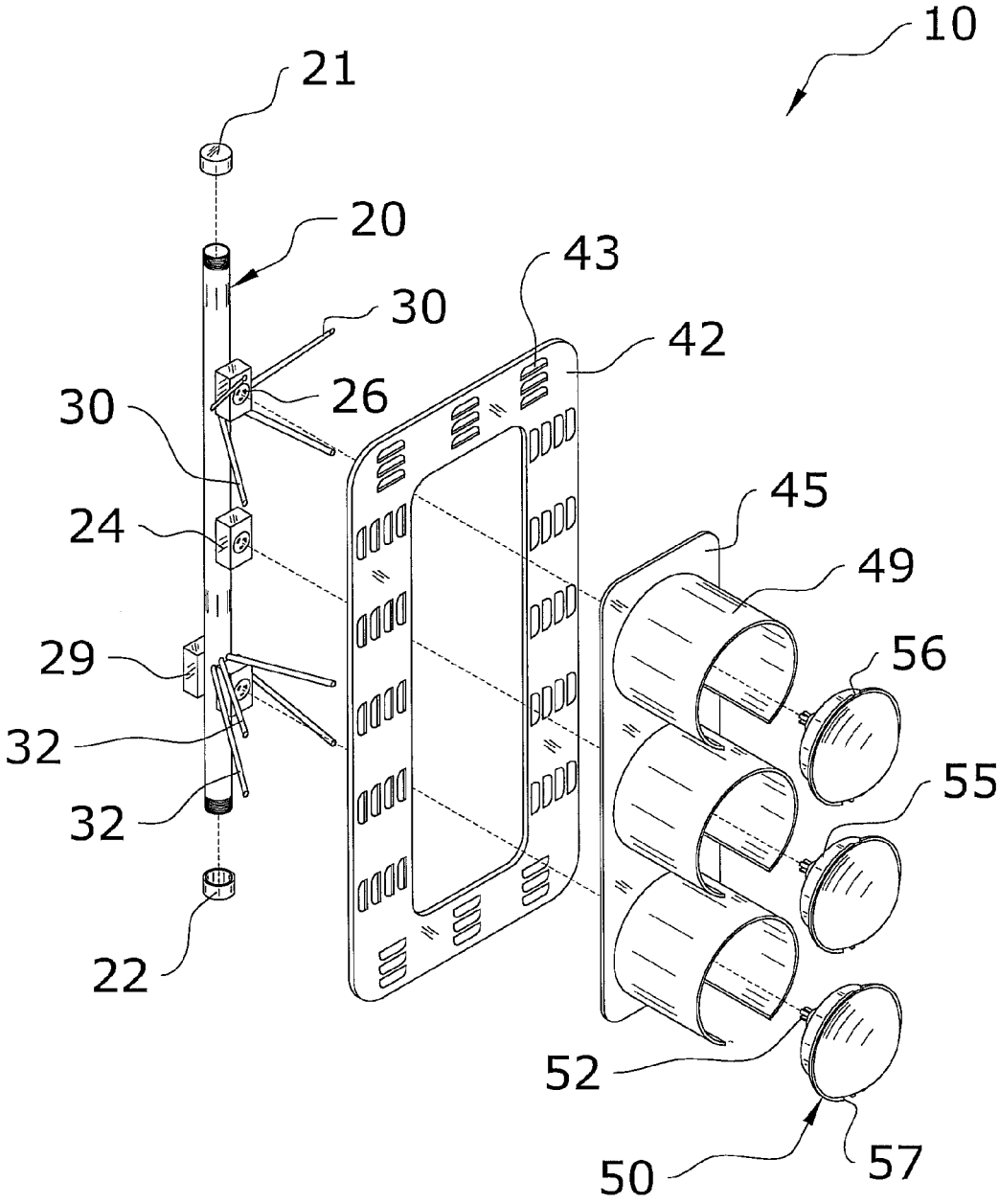
FIG. 2 is am exploded upper perspective view of the present invention.
Figure 3:
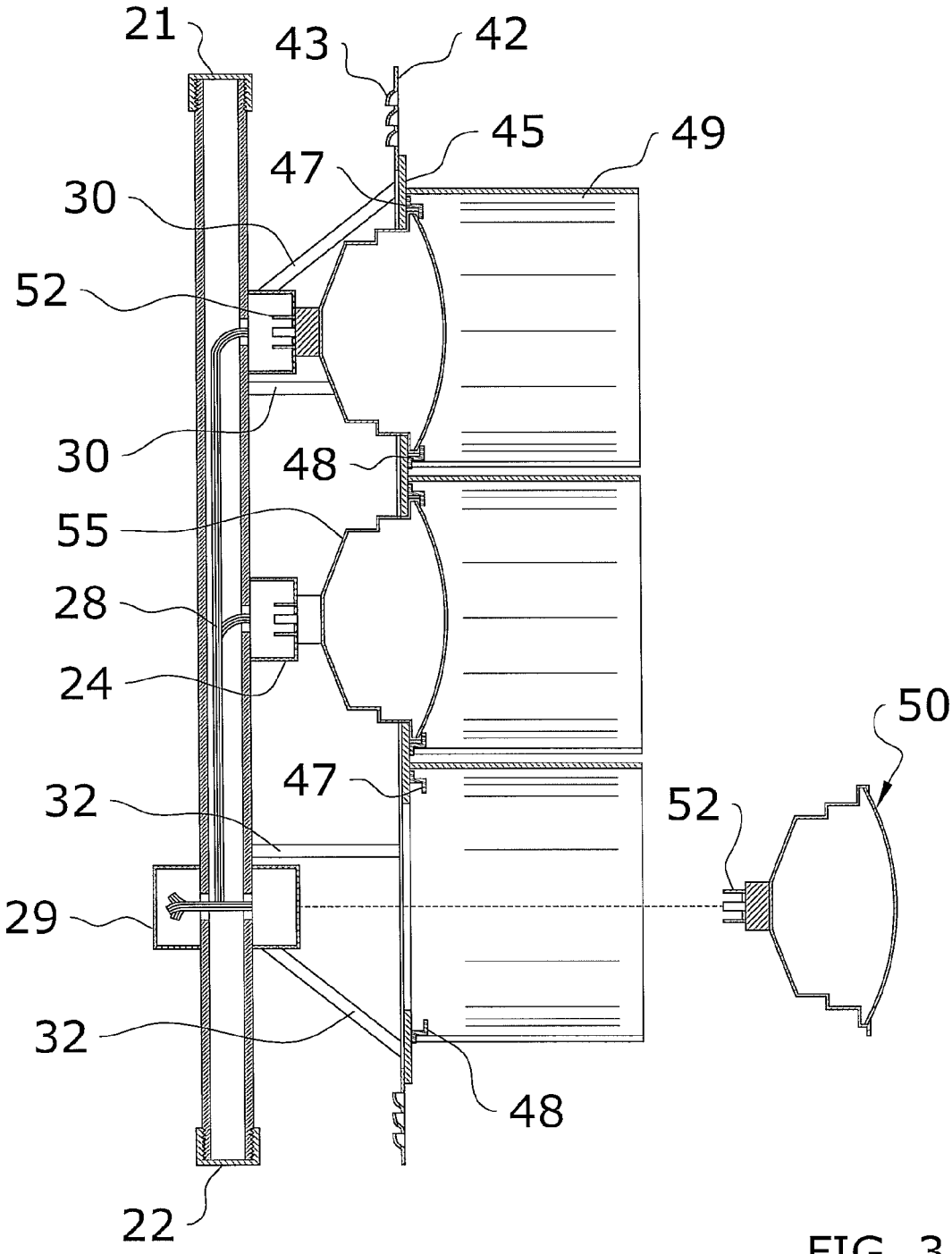
FIG. 3 is a cross-sectional view of the present invention with one light module exploded.

The support member 20 is preferably comprised of a tubular configuration as shown in FIGS. 1 through 3. The support member 20 is also comprised of an elongated configuration to accommodate a plurality of light modules 50. The support member 20 is preferably comprised of a metal material to provide added strength to the traffic signal system 10 and also to endure harsh weather conditions; however the support member 20 may be comprised of alternate materials, such as but not limited to plastic.

The support member 20 includes a first end and a second end opposite the first end. The first end and the second end of the support member 20 are preferably comprised of substantially similar configurations. Further, the first end and the second end of the support member 20 are preferably comprised of a threaded configuration as illustrated in FIGS. 2 and 3.

When the threaded configurations of the first end and the second end are not being utilized a first cap 21 and a second cap 22 are preferably positioned over the first end and the second end as shown in FIGS. 1 through 3. The first cap 21 and the second cap 22 preferably restrict foreign elements (i.e. dust, rain, etc.) from accessing an interior of the support member 20.

At least one receiver member 24 extends out from the support member 20 as illustrated in FIGS. 1 through 4. Further, there are preferably three receiver members 24 extending from the support member 20 to receive three light modules 50; however it is appreciated that there may be more than three receiver members 24 utilized with the traffic signal system 10. The receiver members 24 are preferably comprised of an electrical receptacle configuration. The receiver members 24 are also preferably weatherproof and watertight to withstand harsh weather conditions. The receiver members 24 of the support member 20 are also preferably perpendicularly oriented toward the housing unit 40.

Figure 4:
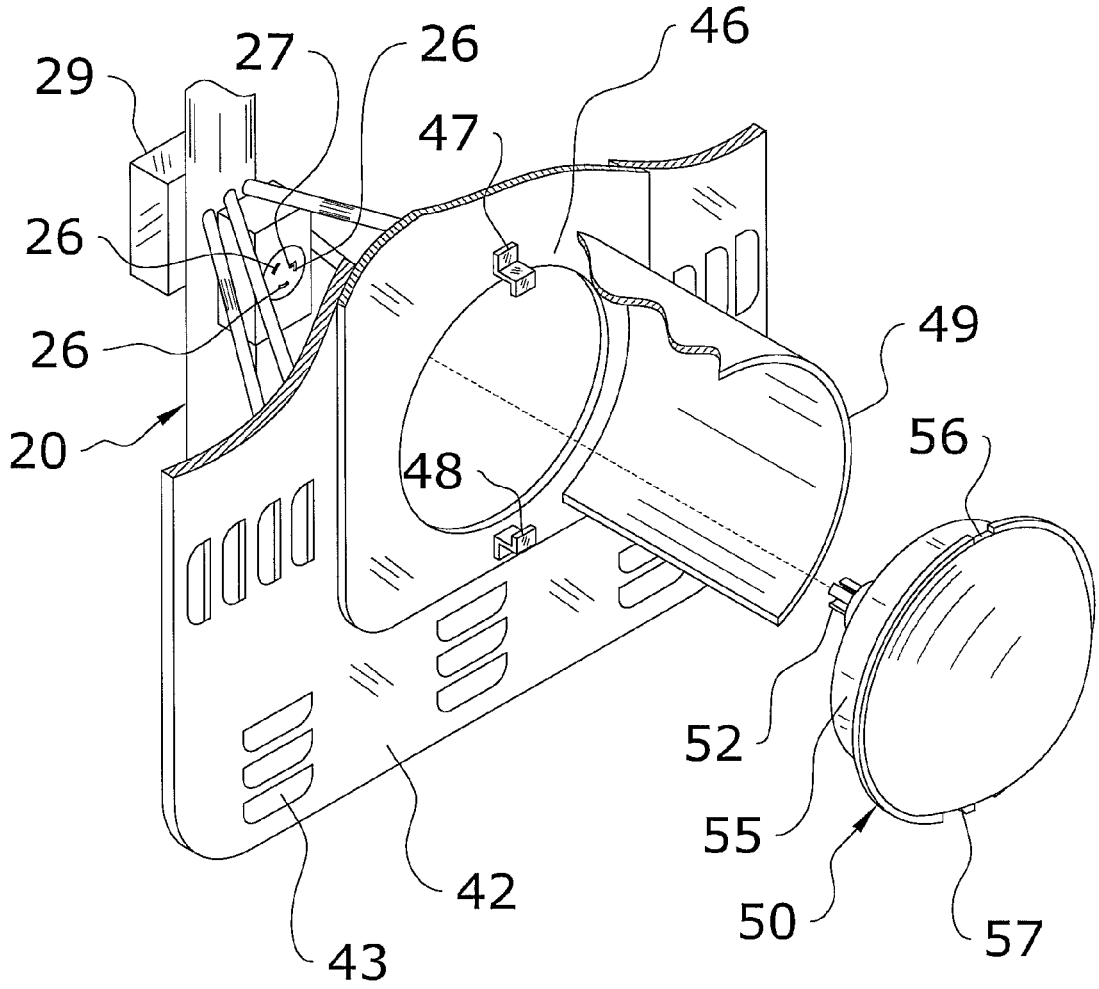
FIG. 4 is a cutaway magnified upper perspective of the present invention.

The receiver members 24 each include a plurality of cavities 26 as shown in FIGS. 2 and 4. The cavities 26 preferably extend into the receiver member 24. The cavities 26 are also comprised of an elongated configuration to secure the plug members 52 of the light module 50. The cavities 26 are preferably positioned around an inner radius of the receiver member 24 as illustrated in FIGS. 2 and 4.

At least one of the cavities 26 preferably includes a first extending portion 27. The first extending portion 27 preferably extends perpendicularly inward from at least one of the cavities 26. It is appreciated that the cavities 26 of the receiver members 24 may be positioned in an alternate configuration rather than the preferred embodiment.

Each of the receiver members 24 preferably include electrically wiring 28, wherein the electrical wiring 28 travels through a hollow interior of the support member 20 and into a container 29 as shown in FIG. 3. The electrical wiring 28 of the receiver members 24 preferably terminates inside the container 29. The container 29 is preferably attached to the support member 20.

The container 29 is preferably comprised of an electrical junction box configuration. The container 29 serves as an access point to the electrical wiring 28 of the traffic signal system 10. The electrical wiring 28 preferably transfers a current source to the receiver members 24. It is appreciated that the receiver members 24 may receive a current source through various other manners rather than the preferred embodiment, such as but not limited to batteries.

C. Attachment Members

The attachment members 30, 32 preferably extend from the support member 20 to a back of the housing unit 40 as shown in FIGS. 1 through 4. Further, the attachment members 30, 32 attach the support member 20 to the housing unit 40. The attachment members 30, 32 are comprised of a strong material, such as but not limited to metal. The attachment members 30, 32 also preferably include a plurality of first attachment members 30 and a plurality of second attachment members 32.

The first attachment members 30 preferably attach an upper end of the support member 20 to an upper end of the housing unit 40 as shown in FIGS. 1 through 3. The second attachment members 32 preferably attach a lower end of the support member 20 to a lower end of the housing unit 40 as shown in FIGS. 1 through 4. The first attachment members 30 and the second attachment members 32 are preferably positioned at an angle to provide added strength to the attachment of the housing unit 40 and the support member 20. It is appreciated that the traffic signal system 10 may use a plurality of different attachment methods to attach the support member 20 to the housing unit 40 rather than the preferred embodiment.

D. Housing Unit

The housing unit 40 is preferably comprised of a separate structure than the support member 20; however it is appreciated that the housing unit 40 may be integrally formed with the support member 20. The housing unit 40 is also preferably comprised of a metal material to provide added strength to the traffic signal system 10 and also to endure harsh weather conditions; however it is appreciated that the housing unit 40 may be comprised of various materials, such as but not limited to plastic.

The housing unit 40 preferably includes a first plate member 42 as shown in FIGS. 1 through 6. The first plate member 42 is preferably comprised of a rectangular configuration; however other configurations may be utilized with the first plate member 42, such as but not limited to a square or circular configuration. The first plate member 42 preferably includes a plurality of vents 43. The vents 43 are preferably positioned throughout the first plate member 42, wherein the vents 43 extend through the first plate member 42. Further, the vents 43 reduce wind resistance upon the traffic signal system 10.

An interior of the first plate member 42 is also preferably cutout to receive a second plate member 45 as illustrated in FIG. 2. The first plate member 42 and the second plate member 45 are preferably separate structures; however it is appreciated that the first plate member 42 and the second plate member 45 may be comprised of an integrally formed structure.

The second plate member 45 is preferably comprised of a rectangular configuration and preferably fits slightly over the cutout portion of the first plate member 42. The second plate member 45 preferably includes at least one opening 46. The opening 46 is preferably substantially similar in diameter to the diameter of an outer edge of a shell 55 of the light module 50 as illustrated in FIGS. 3 through 6. Further, the second plate member 45 preferably includes three openings 46 to receive three light modules 50; however it is appreciated that there may be more than three openings 46 utilized with the traffic signal system 10.

The openings 46 are each preferably positioned along the same longitudinal axis of the support member 20. Each of the centers of the openings 46 preferably align with a center of the receiver member 24. Further, there preferably exist an equal number of openings 46 in the second plate member 45 as there are receiver members 24 along the support member 20 as shown in FIGS. 1 through 3.

The second plate member 45 also preferably includes at least one shield member 49. The shield member 49 preferably extends perpendicularly outward from the outer edge of the openings 46 of second plate member 45 as shown in FIGS. 1 through 4. The shield members 49 help to reduce the glare of the sun upon the light modules 50.

The housing unit 40 also preferably includes a first tab 47 and a second tab 48. The first tab 47 and the second tab 48 are preferably attached substantially near the front outer edge of the openings 46 of the second plate member 45 as illustrated in FIGS. 3 through 6. The first tab 47 and the second tab 48 are preferably positioned 180 degrees apart from each other around the opening 46. It is appreciated however that the first tab 47 and the second tab 48 may be positioned at various places around the opening 46. It is also appreciated that the present invention may include multiple tabs 47, 48 positioned about the opening 46. The first tab 47 preferably prevents the light module 50 from moving horizontally outward while positioned within the opening 46. The second tab 48 preferably prevents the light module 50 from rotating and moving horizontally outward while positioned within the opening 46.

E. Light Module

The light module 50 is preferably comprised of a traffic light module configuration as illustrated in FIGS. 1 through 4. It is appreciated that the traffic signal system 10 preferably includes three light modules 50 as shown in FIGS. 1 through 3; however it is appreciated that there may be more or less than three light modules 50 utilized with the traffic signal system 10. The light modules 50 are also preferably comprised of LED signal modules; however it is appreciated that the light modules 50 may be comprised of various configurations rather than the preferred embodiment.

The light modules 50 are preferably comprised of a configuration substantially similar to the openings 46 of the housing unit 40, wherein the light modules 50 are positioned within the openings 46. The light modules 50 also preferably include a plurality of plug members 52 as shown in FIGS. 2 through 6. The plug members 52 preferably fit within the cavities 26 of the receiver member 24. The plug members 52 and the receiver member 24 are preferably comprised of a twist and lock configuration. Further, the plug members 52 and the receiver member 24 are preferably comprised of an electrical plug and socket configuration, wherein the light module 50 receives power via the plug members 52.

Figure 5:
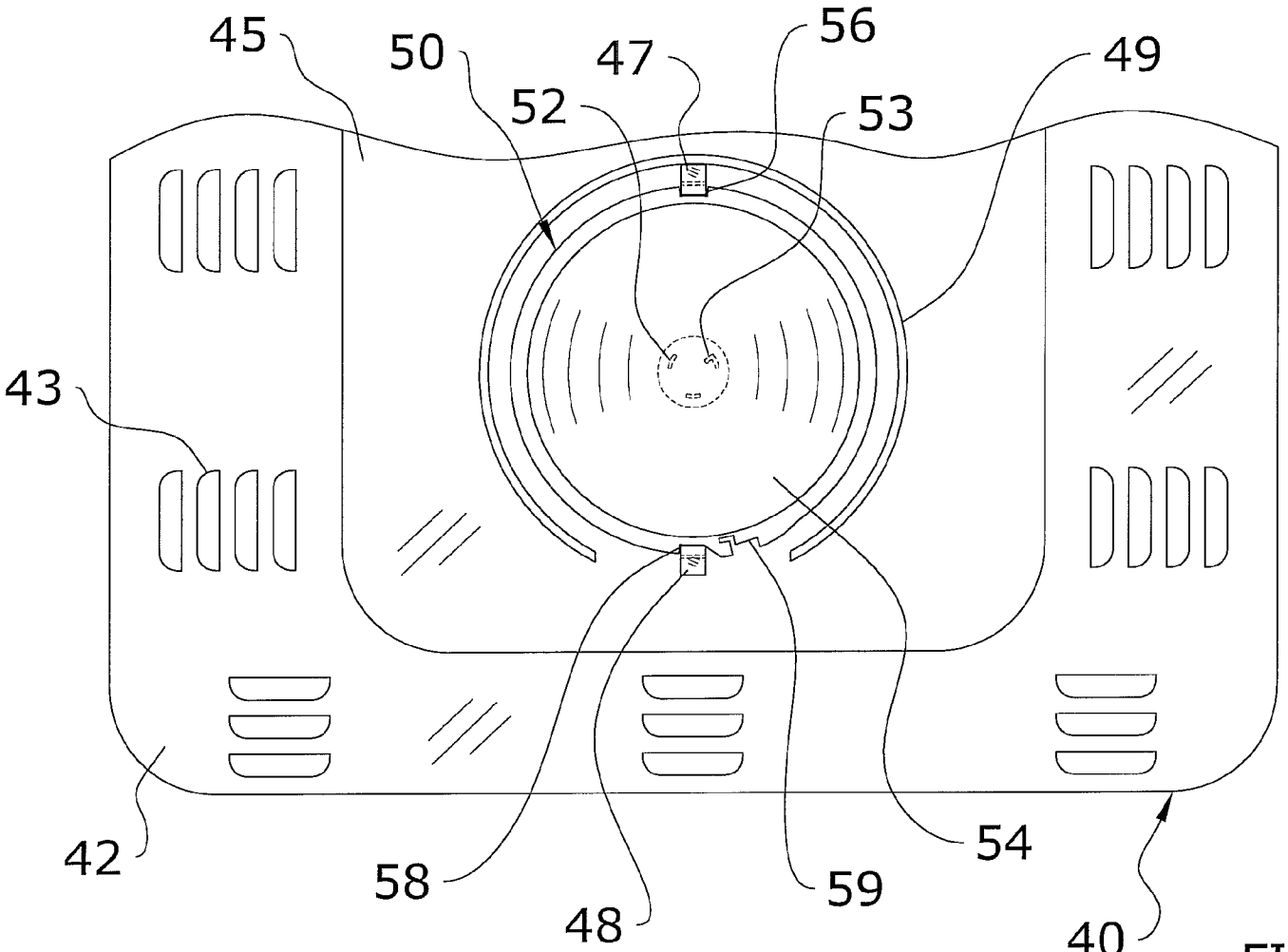
FIG. 5 is a front magnified view of the present invention with the light module in an initial position.
Figure 6:
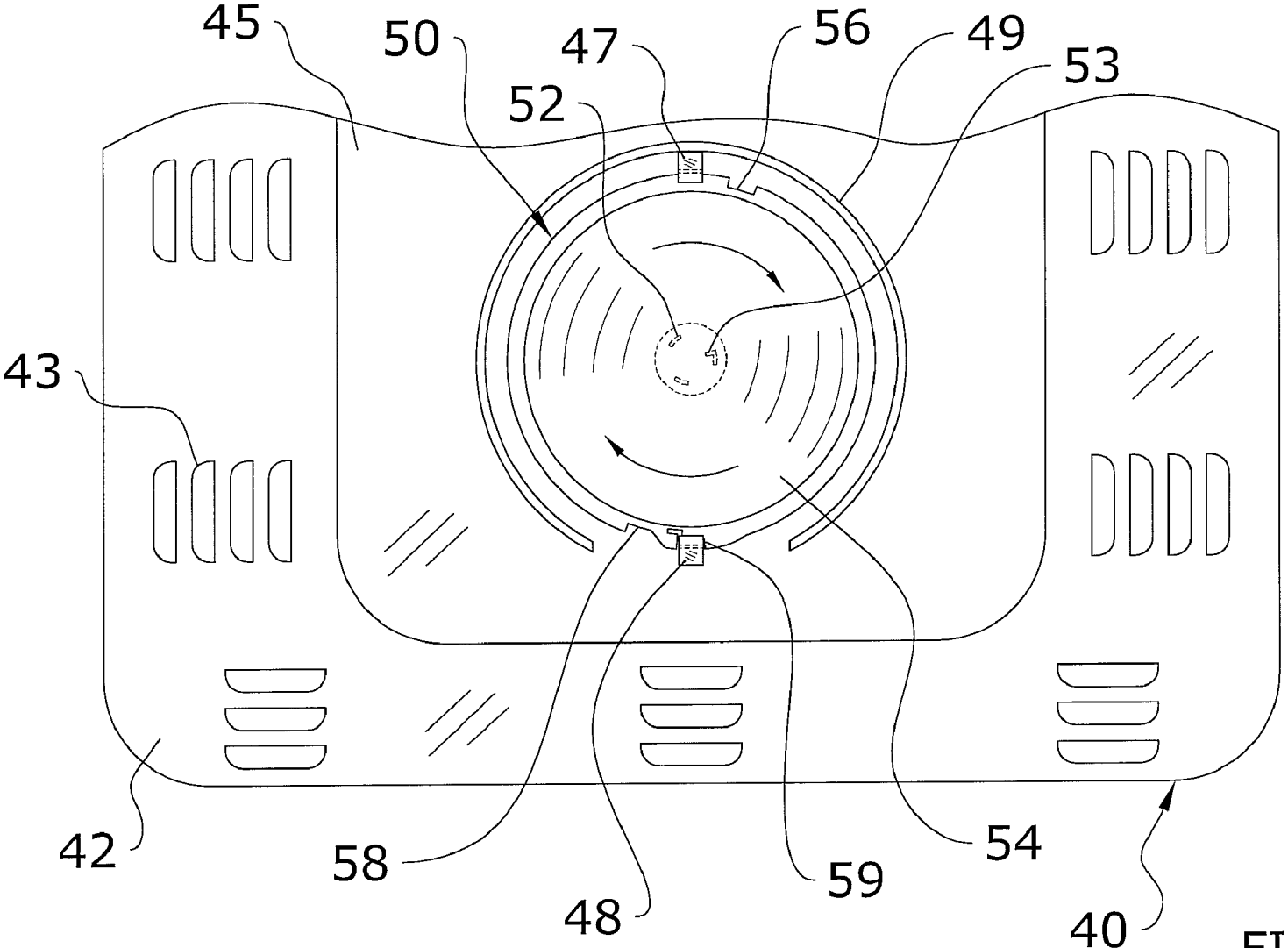
FIG. 6 is a front magnified view of the present invention with the light module in a locked position.

The plug members 52 are preferably comprised of elongated configurations. The length of the plug members 52 is preferably substantially similar to the depth of the cavities 26 of the receiver member 24. The plug members 52 preferably extend out from a rear of the light module 50. Further, the plug members 52 preferably extend out from the light module 50 at a rear center of the light module 50 as shown in FIGS. 5 and 6. The plug members 52 are also preferably positioned around an inner radius of the light module 50.

At least one of the plug members 52 preferably includes a second extending portion 53. The second extending portion 53 preferably extends perpendicularly inward from at least one of the plug members 52. The second extending portion 53 is received by the first extending portion 27 of the cavities 26. When the plug members 52 are inserted into the cavities 26 the light module 50 is preferably rotated so the second extending portion 53 locks the light module 50 within the receiver member 24. It is appreciated that the plug members 52 and the receiver member 24 may be comprised of various electrical plug and socket configurations rather than the preferred embodiment.

The light module 50 also preferably includes a shell 55 surrounding an outer edge of the light module 50 as shown in FIGS. 2 through 4. An outer diameter of the shell 55 is preferably substantially similar to a diameter of the opening 46 of the housing unit 40. The shell 55 preferably fits within the opening 46 of the housing unit 40. A lens 54 is also attached to the outer side of the shell 55. The lens 54 preferably includes a first slot 56 and a second slot 57 positioned about the outer edge as shown in FIGS. 4 through 6. It is appreciated however that the first slot 56 and the second slot 57 may be positioned upon the outer edge of the shell 55. The first slot 56 and the second slot 57 are further preferably positioned 180 degrees apart from each other around the lens 54. It is appreciated that there are an equal number of slots 56, 57 positioned about the light module 50 as there are tabs 47, 48 positioned about the opening 46.

The first slot 56 and the second slot 57 preferably receive the first tab 47 and the second tab 48 respectively when inserting the light module 50 within the opening 46. The first slot 56 is further preferably positioned about the top of the light module 50 and the second slot 57 is preferably positioned about the bottom of the light module 50 so the user may easily access the second slot 57 and second tab 48 through the lower gap in the shield members 49. The radius of the bottom portion of the light module 50 is also preferably slightly greater than the radius of the top portion of the light module 50 as illustrated in FIGS. 3, 5 and 6 so as to properly secure the second tab 48 within the second slot 57.

The first slot 56 is preferably comprised of a recessed configuration upon the outer edge of the lens 54. The first slot 56 receives the first tab 47 when the light module 50 is positioned within the opening 46. Further, an outer lip of the first tab 47 extends horizontally outward from the first slot 56, wherein when the light module 50 is rotated the lip of the first tab 47 catches on the outer edge of the light module 50 thus preventing the light module 50 from moving horizontally outward as illustrated in FIGS. 5 and 6.

The second slot 57 is preferably comprised of a recessed configuration upon the outer edge of the lens 54. The second slot 57 includes a receiving portion 58 and a locking portion 59. The outer edges of the locking portion 59 preferably extend slightly downward to catch the horizontal portion of the second tab 48 as illustrated in FIGS. 5 and 6. The second slot 57 receives the second tab 48 when the light module 50 is positioned within the opening 46. The horizontal portion of the second tab 48 is initially positioned along an outer edge of the receiving portion 58, wherein when the light module 50 is rotated the horizontal portion of the second tab 48 is positioned within the locking portion 59 to prevent the light module 50 from rotating further as illustrated in FIGS. 5 and 6.

Further, an outer lip of the second tab 48 is preferably initially positioned within the receiving portion 58 of the second slot 57, wherein when the light module 50 is rotated the lip of the second tab 48 is repositioned over the locking portion 59 to prevent the light module 50 from moving horizontally outward as illustrated in FIGS. 5 and 6. The second tab 48 preferably locks within the locking portion 59 of the second slot 57 at a simultaneous time as the plug members 52 lock into the receiver member 24 when rotating the light module 50.

The second tab 48 is released from the locking portion 59 and forced into the receiving portion 58 by pushing a dividing member between the receiving portion 58 and the locking portion 59 perpendicularly away from the receiving portion 58 and locking portion 59. When the second tab 48 is positioned within the receiving portion 58 the light module 50 is preferably able to be removed from the housing unit 40 and the support member 20.

F. In Use

In use, the support member 20 is first mounted at an adequate position to serve as a traffic signal light. The support member 20 may be mounted via threadably mounting the first end and second end to a support structure. The support member 20 may also be mounted by being clamped against a pole or other structure. It is appreciated that the traffic signal system 10 may be mounted in a plurality of other manners consistent with mounting a traffic light.

After the traffic signal system 10 is securely mounted the electrical wiring 28 may be accessed via the container 29 and subsequently connected to an outside power source. The light modules 50 are now inserted within the openings 46 of the housing unit 40 so the second extending portion 53 of the plug members 52 enters the first extending portion 27 of the cavities 26 and the first tab 47 extends through the first slot 56 and the second tab 48 extends within the second slot 57, referred to as the initial position. The light modules 50 are now rotated, thus securing the light modules 50 within the housing unit 40 and support member 20.

When removing a light module 50 from the housing unit 40 and support member 20 the lens 54 is depressed firmly substantially near the slot 57 to disengage the second tab 48 and the light module 50 is pushed slightly inward to disengage the plug members 52. The light module 50 is now rotated in an opposite direction as the light module 50 was rotated when the light module 50 was attached to the housing unit 40 and the support member 20. Once the light module 50 reaches the initial position it may be removed by pulling the light module 50 perpendicularly outward from the opening 46 and the receiver member 24. Another light module 50 may subsequently be replaced within the housing unit 40 and the support member 20.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A traffic signal system, comprising:

a support member including at least one receiver member, wherein said at least one receiver member includes at least one cavity;

at least one light module including at least one plug member extending outwardly from said at least one light module;

wherein said at least one plug member is positionable within said at least one cavity of said receiver member;

wherein said at least one light module is comprised of a traffic light configuration; and a housing unit including at least one opening, wherein said housing unit is attached to said support member and wherein said at least one light module fits within said at least one opening;

wherein said housing unit includes at least one tab member positioned about said opening;

wherein said at least one light module includes at least one slot, wherein said at least one tab is positioned within said at least one slot.

2. The traffic signal system of claim 1, wherein said at least one tab member is positioned about a front of said housing unit.

3. The traffic signal system of claim 1, wherein said at least one light module includes at least one slot, wherein said at least one tab is extends through said at least one slot.

4. The traffic signal system of claim 1, wherein said at least one tab member comprises a first tab member and a second tab member.

5. The traffic signal system of claim 4, wherein said first tab is positioned 180 degrees about said opening from said second tab.

6. The traffic signal system of claim 4, wherein said first tab member and said second tab member are positioned about a front of said housing unit.

7. The traffic signal system of claim 4, wherein said at least one slot comprises a first slot and a second slot, wherein said first tab member extends through said first slot and wherein said second tab member extends within said second slot.

8. The traffic signal system of claim 7, wherein said first slot is positioned 180 degrees about said light module from said second slot.

9. The traffic signal system of claim 1, wherein said housing unit includes at least one shield member extending perpendicularly outward from an outer edge of said at least one opening.

10. The traffic signal system of claim 1, wherein said housing unit is comprised of a rectangular configuration.

11. The traffic signal system of claim 1, wherein said housing unit includes a plurality of vents.

12. The traffic signal system of claim 1, wherein a first diameter of said at least one opening is substantially similar to a second outer diameter of said at least one light module.

13. The traffic signal system of claim 1, wherein said support member is comprised of a tubular configuration.

14. The traffic signal system of claim 1, wherein said support member includes a first end and a second end, wherein said first end and said second end are comprised of a threaded configuration.

15. A traffic signal system, comprising:

a support member including at least one receiver member, wherein said at least one receiver member includes at least one cavity;

a housing unit including at least one opening, wherein said housing unit is attached to said support member and wherein said at least one light module fits within said at least one opening;

at least one light module including at least one plug member extending outwardly from said at least one light module;

wherein said at least one plug member is positionable within said at least one cavity of said receiver member;

wherein said at least one light module is comprised of a traffic light configuration;

wherein said housing unit includes a first tab member and a second tab member, wherein said first tab is positioned 180 degrees about said opening from said second tab;

wherein said first tab member and said second tab member are positioned about a front of said housing unit;

wherein said at least one light module includes a first slot and a second slot, wherein said first tab member extends through said first slot and wherein said second tab member extends within said second slot;

wherein said first slot is positioned 180 degrees about said light module from said second slot; and at least one shield member extending perpendicularly outward from an outer edge of said at least one opening;

wherein said housing unit is comprised of a rectangular configuration;

wherein said housing unit includes a plurality of vents;

wherein a first diameter of said at least one opening is substantially similar to a second outer diameter of said at least one light module;

wherein said support member is comprised of a tubular configuration;

wherein said support member includes a first end and a second end, wherein said first end and said second end are comprised of a threaded configuration.

16. A traffic signal system, comprising:

a support member;

a plurality of electrical receptacles connected to said support member;

a plate member connected to said support member;

wherein said plate member includes a plurality of openings aligned with said plurality of electrical receptacles wherein said plate member includes a first tab aligned with each of said plurality of openings; and a plurality of light modules positioned within said plurality of openings;

wherein said plurality of light modules each include a first slot formed within an outer edge of said plurality of light modules;

wherein each of said plurality of light modules has a first rotational position;

wherein said first slot is aligned with said first tab in said first rotational position to allow said light module to electrically connect to said electrical receptacle;

wherein each of said plurality of light modules has a second rotational position;

wherein said first slot is not aligned with said first tab in said second rotational position to prevent said light module from being electrically disconnected from said electrical receptacle.

17. The traffic signal system of claim 16, wherein said plate member includes a second tab aligned with each of said plurality of openings and wherein said plurality of light modules each include a second slot formed within an outer edge of said plurality of light modules to receive said second tab.

18. The traffic signal system of claim 17, wherein said second slot includes a first portion and a second portion, wherein said second portion is separated from said first portion.

19. The traffic signal system of claim 18, wherein said second slot includes a first portion and a second portion separated by a divider portion.

20. The traffic signal system of claim 19, wherein said first portion of said second slot is aligned with said second tab in said first rotational position and wherein said second portion of said second slot is aligned with said second tab in said second rotational position.

* * * * *